United States Patent [19]

Kuehler

[11] Patent Number: 4,510,038

[45] Date of Patent: Apr. 9, 1985

[54] COAL LIQUEFACTION USING VACUUM DISTILLATION AND AN EXTERNAL RESIDUUM FEED

[75] Inventor: Christopher W. Kuehler, Larkspur, Calif.

[73] Assignee: Chevron Research Company, San Francisco, Calif.

[21] Appl. No.: 434,656

[22] Filed: Oct. 15, 1982

[51] Int. Cl.[3] ..... C10G 1/06; C10G 1/00

[52] U.S. Cl. ..... 208/10; 208/8 LE

[58] Field of Search ..... 208/8 LE, 10

[56] References Cited

U.S. PATENT DOCUMENTS

| | | | |
|---|---|---|---|
| 2,931,765 | 4/1960 | Glinka | 208/8 LE |
| 3,705,092 | 12/1972 | Gatsis | 208/8 LE |
| 4,077,867 | 3/1978 | Aldridge et al. | 208/10 |
| 4,108,758 | 8/1978 | Schoennagel | 208/8 LE |
| 4,111,786 | 9/1978 | Sugimura et al. | 208/10 X |
| 4,264,428 | 4/1981 | Schoennagel et al. | 208/10 |
| 4,264,430 | 4/1981 | Kuehler | 208/10 |
| 4,269,696 | 5/1981 | Metrailer | 208/10 X |
| 4,283,268 | 8/1981 | Rosenthal et al. | 208/8 LE |
| 4,300,996 | 11/1981 | Kuehler | 208/10 |
| 4,306,960 | 12/1981 | Gleim | 208/8 LE |
| 4,330,390 | 5/1982 | Rosenthal et al. | 208/10 |
| 4,330,393 | 5/1982 | Rosenthal et al. | 208/10 |
| 4,338,183 | 7/1982 | Gatsis | 208/10 |
| 4,372,838 | 2/1983 | Kulik et al. | 208/8 LE X |
| 4,376,695 | 3/1983 | Belinko et al. | 208/10 X |
| 4,379,744 | 4/1983 | Rosenthal et al. | 208/8 LE X |

FOREIGN PATENT DOCUMENTS

| | | | |
|---|---|---|---|
| 2444827 | 9/1974 | Fed. Rep. of Germany | 208/10 |

*Primary Examiner*—William G. Wright

*Attorney, Agent, or Firm*—S. R. La Paglia; S. H. Roth; Q. T. Dickinson

[57] ABSTRACT

A process for liquefying coal in which a slurry comprising a petroleum or petroleum-derived solvent and particulate coal is heated in a dissolution zone to substantially dissolve the coal and produce a first effluent containing undissolved solids to which petroleum residuum is added to produce a second effluent which is distilled under reduced pressure. The process eliminates the need for physical solids separation such as filtration or centrifugation and is most advantageously employed in high-severity coal liquefaction.

15 Claims, No Drawings

COAL LIQUEFACTION USING VACUUM DISTILLATION AND AN EXTERNAL RESIDUUM FEED

BACKGROUND OF THE INVENTION

The present invention relates to an improved process for the liquefaction of raw coal. More particularly, the invention relates to a coal liquefaction process in which physical solids separation such as filtration or centrifugation may be replaced by distillation while still maintaining the recovery of high quality heavy distillate.

In any coal liquefaction process, the liquid product (coal-derived liquid) is a viscous slurry having a very complex chemical composition which includes a significant portion of solids such as ash, char and refractory organic compounds. The solids must be separated at some stage in the liquefaction process to prevent scaling, plugging and fouling of downstream equipment and to remove heteroatom contaminants and ash from the final product. Because a sizable percentage of the solid content of coal-derived liquids is in the micron to submicron size range, the problem of separating fine ash, char and refractory solids from unfiltered coal-derived liquids is a most difficult problem.

The present invention provides a method of separating solids from a coal-derived liquid which is particularly useful in a high-severity coal liquefaction process. The present invention also provides a means for eliminating such solids separation steps as filtration or centrifugation.

SUMMARY OF THE INVENTION

The present invention relates to a process for liquefying coal. The process comprises the steps of heating a slurry comprising a solvent and particulate coal in a dissolution zone to substantially dissolve the coal to produce a first effluent; adding petroleum residuum to at least a portion of the first effluent to produce a second effluent; and distilling the second effluent under reduced pressure to produce an overhead fraction and a bottoms fraction.

DETAILED DESCRIPTION OF THE PREFERRED EMBODIMENTS

The present invention relates to a process for liquefying coal. Generally, in a direct coal liquefaction process, distillation is used to generate a middle distillate recycle oil, the endpoint of which is determined by the maximum allowable solids concentration in the residuum. Thus, for a process in which little high boiling material is produced, the endpoint is pushed down and valuable liquid remains with unreacted coal and mineral matter. In addition, the effectiveness of the recycle oil is reduced by lowering its endpoint. It is not necessary for the recycle oil to be a middle distillate for this problem to occur. The problem can even be worse if an initial solids separation step is used to concentrate the solids in the product and then distillation is used to remove them. In this case, the recycle oil would be full boiling range.

In accordance with the invention, an external source of residuum, preferably low solids content petroleum residuum, and most preferably a low quality petroleum residuum is added before vacuum distillation to alleviate these problems. The added residuum may be cut with lower boiling stock to facilitate its handling, although this may contaminate the coal products. Employing this concept, physical solids separation such as filtration or centrifugation is replaced by a much simpler distillation stage.

The present process may be employed with any coal liquefaction process and is particularly useful in high-severity liquefaction. The most preferred coal liquefaction process of the present invention is carried out in at least two separate and distinct reaction stages. The coal is substantially dissolved in a high temperature first stage by heating a slurry comprising a solvent (i.e., a slurry vehicle) and particulate coal in a dissolution zone in the presence of hydrogen to substantially dissolve the coal, e.g., at least about 50% dissolution of the coal on a moisture- and ash-free basis. The effluent slurry from the dissolution step is composed of a normally liquid portion comprising heptane-soluble liquids, as well as light gases ($H_2$, $C_4$—, $H_2O$, $NH_3$, $H_2S$, etc.) and undissolved solids. The undissolved solids include undissolved coal and ash particles. The normally liquid portion comprises solvent and dissolved coal and contains nondistillable components. The term "solvent" also includes solvent materials which have been converted in the dissolution stage. At least a portion, preferably all, of the normally liquid portion containing undissolved solids optionally along with the gaseous components, is passed to a second reaction zone wherein it is reacted with hydrogen in the presence of an externally-supplied hydrogenation catalyst under hydrogenation conditions. These hydrogenation conditions preferably include a temperature lower than the temperature to which the slurry is heated in the first stage. If desired, the normally liquid effluent from the first stage can be treated in an intermediate step prior to passage to the second hydrogenation zone of this invention. The intermediate step can be treatment in a catalytic or noncatalytic reactor, a guard bed reactor, etc. Such intermediate steps are described in commonly assigned, co-pending U.S. patent application Ser. No. 106,580, filed Dec. 26, 1979, entitled "Three-Stage Coal Liquefaction Process", in commonly assigned U.S. Pat. No. 4,264,430, issued Apr. 28, 1981 for "Three-Stage Coal Liquefaction Process" and in commonly assigned U.S. Pat. No. 4,283,268, issued Aug. 11, 1981 for "Two-Stage Coal Liquefaction Process With Interstage Guard Bed," the disclosures of which are incorporated herein by reference.

According to this invention at least a portion of the normally liquid product of the first reaction zone, with or without intermediate treatment, and most preferably containing undissolved solids, is contacted with hydrogen and a catalyst in the second zone, most preferably operated at a lower temperature. At least some or all of the undissolved solids can be removed between stages, but such interstage solids removal is not recommended because of the high viscosity of the liquid portion and because it would likely result in reduced yield. Preferably, the second hydrogenation zone contains a bed of hydrogenation catalyst particles which are preferably in the form of catalytic hydrogenation components supported on an inorganic refractory porous support. The hydrogenation catalyst can be present as a fixed bed, a packed bed which can be a continuously or periodically moving, or an ebullating bed. Preferably, the feed to the second reaction zone is passed upwardly through the catalyst bed.

FEEDSTOCKS

The basic feedstock to the process of this invention is coal, e.g., bituminous coal, subbituminous coal, brown coal, lignite, peat, etc. The coal should preferably be ground finely to provide adequate surface for dissolution. Preferably, the particle sizes of coal should be smaller than ¼ inch in diameter and most preferably smaller than 100 mesh (Tyler sieve size) and finer; however, larger sizes can be utilized. The coal can be added as a dry solid or as a slurry. If desirable, the coal can be ground in the presence of a slurrying oil.

DISSOLUTION SOLVENT

The solvent materials, i.e. slurry vehicles, useful in the process of this invention are preferably obtained at least in part from the process effluent of the second stage hydrogenation zone. A portion of the slurry vehicle may also include other materials such as crude petroleum or petroleum-derived materials such as petroleum residua, tars, asphaltic petroleum fractions, topped crudes, tars from solvent deasphalting of petroleum, etc. Petroleum-derived solvent components preferably contain only components boiling above about 200° C. When crude petroleum or petroleum-derived liquids which contain soluble metals contaminants such as nickel, vanadium and iron, are employed as solvent components, soluble metals are deposited on particles of unreacted coal or coal ash. In addition, coking of the slurry vehicle is reduced by the presence of the coal solids.

DISSOLVING ZONE (FIRST STAGE)

Particulate coal can be mixed with solvent, preferably in a solvent:coal weight ratio from about 1:2 to 5:1, more preferably from about 1:1 to 2:1. The mixing can occur in slurry vessel where the slurry is fed to a dissolver. In the dissolving zone, the slurry is heated to a temperature preferably from about 400° C. to 480° C., more preferably 425° C. to 450° C., and most preferably 435° C. to 450° C. for a length of time sufficient to substantially dissolve the coal. At least about 50% by weight, and more preferably greater than 70% by weight, and still more preferably greater than 90% by weight of the coal on a moisture- and ash-free basis is dissolved in the dissolver, thereby forming a mixture of solvent, dissolved coal and insoluble coal solids. Hydrogen is also introduced in the dissolving zone and can comprise fresh hydrogen and/or recycled gas. Carbon monoxide can be present in either reaction zone if desired but preferably the gas feed to both reaction zones is free of added carbon monoxide. Reaction conditions in the dissolver can vary widely in order to obtain at least 50% dissolution of coal solids. Normally, the slurry should be heated to at least about 400° C. in order to obtain at least 50% dissolution of coal in a reasonable time. Further, the coal should not be heated to temperatures much above 480° C. since this results in thermal cracking which would substantially reduce the yield of normally liquid products. Other reaction conditions in the dissolving zone include a residence time of 0.1 to 3 hours, preferably 0.1 to 1.0 hour; a pressure in the range of 70 to 700 atmospheres, preferably 100 to 350 atmospheres, and more preferably 100 to 170 atmospheres; and a hydrogen gas rate of 170 to 3500 cubic meters per cubic meter of slurry, and preferably 500 to 1780 cubic meters per cubic meter of slurry. It is preferred that the hydrogen pressure in the dissolving zone be maintained above 35 atmospheres. The feed may flow upwardly or downwardly in the dissolving zone, preferably upwardly. Preferably, the dissolving zone is elongated sufficiently so that plug flow conditions are approached. A suitable flow distributor for introducing the feed into the dissolving zone is described in commonly assigned U.S. patent application Ser. No. 160,793, filed June 19, 1980 and entitled "Gas Pocket Distributor For An Upflow Reactor," which is incorporated herein by reference. The dissolving zone can be operated with no catalyst or contact particles from any external source, although the mineral matter contained in the coal may have some catalytic effect. It has been found, however, that the presence of a dispersed dissolution catalyst can result in the increased production of lighter liquid products and in some cases can increase the overall coal conversion in the process. It is preferred, however, that the first stage dissolver contain no nominally noncatalytic contact particles such as alumina, silica, etc. "Nominally noncatalytic particles" are particles which do not contain externally-supplied transition metals as hydrogenation components.

The dissolution catalyst, if employed, can be any of the well known materials available in the prior art, and contains an active catalytic component in elemental or compound form. Examples include finely divided particles, salts, or other compounds of tin, lead, or the transition elements, particularly Groups IV-B, V-B, VI-B or Group VIII of the Periodic Table of the Elements, as shown in *Handbook of Chemistry and Physics,* 45th Edition, Chemical Rubber Company, 1964. For purposes of this disclosure the dissolution catalyst composition is defined as the composition of the catalyst material added to the process, regardless of the form of the catalytic elements in solution or suspension.

The dispersed dissolution catalyst can be dissolved or otherwise suspended in the liquid phase, e.g., as fine particles, emulsified droplets, etc., and is entrained from the first stage in the liquid effluent. The dispersed catalyst can be added to the coal before contact with the solvent, it can be added to the solvent before contact with the coal, or it can be added to the coal-solvent slurry. A particularly satisfactory method of adding the dispersed catalyst is in the form of an oil/aqueous solution emulsion of a water-soluble compound of the catalyst hydrogenation component. The use of such emulsion catalysts for coal liquefaction is described in U.S. Pat. No. 4,136,013 to Moll et al for "Emulsion Catalyst for Hydrogenation Processes", Jan. 23, 1979, the disclosure of which is incorporated herein by reference. The water soluble salt of the catalytic metal can be essentially any water soluble salt of metal catalysts such as those of the iron group, tin or zinc. The nitrate or acetate may be the most convenient form of some metals. For molybdenum, tungsten or vanadium, a complex salt such as an alkali metal or ammonium molybdate, tungstate, or vanadate may be preferable. Mixtures of two or more metal salts can also be used. Particular salts are ammonium heptamolybdate tetrahydrate [$(NH_4)_6Mo_7O_{24}.4H_2O$], nickel dinitrate hexahydrate [$Ni(NO_3)_2.6H_2O$], and sodium tungstate dihydrate [$NaWO_4.2H_2O$]. Any convenient method can be used to emulsify the salt solution in the hydrocarbon medium. A particular method of forming the aqueous-oil emulsion is described in the above-mentioned U.S. Pat. No. 4,136,013.

If dissolution catalysts are added as finely divided solids they can be added as particulate metals, their oxides, sulfides, etc., e.g., $FeS_x$; waste fines from metal refining processes, e.g., iron, molybdenum, and nickel; crushed spent catalysts, e.g., spent fluid catalytic cracking fines, hydroprocessing fines, recovered coal ash, and solid coal liquefaction residues. It is contemplated that the finely divided dissolution catalyst added to the first stage will generally be an unsupported catalyst; that is, it need not be supported on inorganic carriers such as silica, alumina, magnesia, etc. However, inexpensive waste catalyst fines containing catalytic metals may be used, if desired.

The dispersed dissolution catalyst can also be an oil-soluble compound containing a catalytic metal, for example, phosphomolybdic acid, naphthenates of molybdenum, chromium, and vanadium, etc. Suitable oil-soluble compounds can be converted to dissolution catalysts in situ. Such catalysts and their utilization are described in U.S. Pat. No. 4,077,867 for "Hydroconversion of Coal in a Hydrogen Donor Solvent with an Oil-Soluble Catalyst" issued Mar. 7, 1978, the disclosure of which is incorporated by reference.

HYDROGENATION ZONE (SECOND STAGE)

The dissolution zone effluent contains normally gaseous, normally liquid, and undissolved solid components including undissolved coal, coal ash, and in some cases particles of dispersed catalysts. The entire effluent from the first stage zone can be passed directly to a second stage hydrogenation zone. Optionally, light gases, e.g., $C_4$—, water, $NH_3$, $H_2S$, etc., can be removed from the product of the first stage before passage of preferably the entire normally liquid effluent and the solids fraction to the second stage. Feed to the second stage should preferably contain at least a major portion (more than 50% by weight) of the normally liquid product of the first stage as well as the undissolved coal solids and dispersed hydrogenation catalyst, if any. The liquid feed to the second stage should at least contain the heaviest liquid portion of the first stage liquid product, e.g., 200° C.+ or 350° C.+ fractions, which contain non-distillable components. In the second stage hydrogenation zone, the liquid-solids feed is contacted with hydrogen. The hydrogen may be present in the effluent from the first stage or may be added as supplemental hydrogen or recycle hydrogen. The second stage reaction zone contains the second hydrogenation catalyst which is normally different from the dissolution catalysts which may be employed in the first stage. The second stage hydrogenation catalyst is preferably one of the commercially available supported hydrogenation catalysts, e.g., a commercial hydrotreating or hydrocracking catalyst. Suitable catalysts for the second stage preferably comprise a hydrogenation component and a cracking component. Preferably, the hydrogenation component is supported on a refractory cracking base, most preferably a weakly acidic cracking base such as alumina. Other suitable cracking bases include, for example, two or more refractory oxides such as silica-alumina, silica-magnesia, silica-zirconia, alumina-boria, silica-titania, clays, and acid-treated clays such as attapulgite, sepiolite, halloysite, chrysolite, palygorskite, kaolinite, imogolite, etc. Suitable hydrogenation components are preferably selected from Group VI-B metals, Group VIII metals, or their oxides, sulfides, and mixtures thereof. Particularly useful combinations are cobalt-molybdenum,nickel-molybdenum, or nickel-tungsten, on alumina supports. A preferred catalyst is comprised of an alumina matrix containing about 8% nickel, 20% molybdenum, 6% titanium, and 2% to 8% phosphorus, such as can be prepared using the general cogellation procedures described in U.S. Pat. No. 3,401,125 to Jaffe, Sept. 10, 1968, for "Coprecipitation Method For Making Multi-Component Catalyst," which is incorporated herein by reference, wherein phosphoric acid is employed as a phosphorus source.

It is important in the process of the present invention that the temperatures in the second stage hydrogenation zone are not too high because it has been found that second stage catalysts rapidly foul at high temperatures. This is particularly important when fixed or packed beds are employed which do not permit frequent catalyst replacement. The temperatures in the second hydrogenation zone should normally be maintained below about 425° C., preferably in the range above 310° C., and more preferably 340° C. to 400° C.; however, higher end-of-run temperatures may be tolerable in some cases. Generally, the temperature in the second hydrogenation zone will always be at least about 15° C. below the temperature in the first hydrogenation zone and preferably 55° C. to 85° C. lower. Other typical hydrogenation conditions in the second hydrogenation zone include a pressure of 70 to 700 atmospheres, preferably 70 to 200 atmospheres, and more preferably 100 to 170 atmospheres; hydrogen rates of 350 to 3500 cubic meters per cubic meter of slurry, preferably 500 to 1780 cubic meters per cubic meter of slurry; and a slurry hourly space velocity in the range of 0.1 to 2, preferably 0.1 to 1.0 hours$^{-1}$. The pressure in the catalytic hydrogenation zone can be essentially the same as the pressure in the dissolution zone, if desired.

The catalytic hydrogenation zone is preferably operated as an upflow packed or fixed bed; however, an ebullating bed may be used. The packed bed may move continuously or intermittently, preferably countercurrently to the slurry feed, in order to permit periodic, incremental catalyst replacement. It may be desirable to remove light gases generated in the first stage and to replenish the feed in the second stage with hydrogen. Thus, a higher hydrogen partial pressure will tend to increase catalyst life.

When a fixed or packed bed is employed in the second hydrogenation stage, it is preferred that the severity of the second stage be limited to avoid undesirable asphaltene precipitation which leads to undue plugging and pressure drops. This method of operation is described in commonly assigned U.S. patent application Ser. No. 278,976, filed June 29, 1981, for "Hydroprocessing Carbonaceous Feedstocks Containing Asphaltenes," incorporated herein by reference. The feed into the second stage is preferably fed through a distributor system as disclosed in the above-mentioned, commonly assigned U.S. patent application Ser. No. 160,793.

DOWNSTREAM PROCESSING

The product effluent from the hydrogenation zone is generally separated into a gaseous fraction and a liquid-solids fraction. The gaseous fraction is separated into a hydrogen stream, a $C_1$–$C_3$ stream, an $H_2O/NH_3/H_2S$ stream, and a $C_4$–$C_6$ naphtha stream. A scrubbing solvent can be added, if desired. Preferably, the $H_2$ is separated from other gaseous components and recycled to the second stage hydrogenation or the first stage dissolving stages as desired. The liquid-solids fraction is generally flashed and a gas stream containing $H_2O$ and naphtha is recovered.

In accordance with the invention, residuum, preferably petroleum residuum, most preferably one of low quality is added to the product effluent from the liquefaction stage. The residuum may be added to the product effluent from a single-stage liquefaction or to the above-described hydrogenation effluent, with or without the above-described preliminary fractionations. In any event, after liquefaction, residuum, preferably petroleum residuum having a low solids content, typically less than about 1% by weight, is added to the liquefaction effluent. The resulting effluent is then passed to a vacuum distillation column in which it is distilled under reduced pressure. In the process of the invention, the vacuum distillation column acts as a means for separating solids from the liquefaction effluent. In the vacuum distillation column, the feed is distilled under reduced pressure to permit the recovery of an overhead fraction which may comprise light coal products and heavy and middle distillate oils. This distillate oil which is coal-derived may be recycled for use as the coal dissolution solvent. Any gases removed may either be used as fuel, passed to a steam reformer to produce hydrogen for recycling to the process where needed, or used for other purposes.

The bottoms fraction withdrawn from the vacuum distillation column consists primarily of high molecular weight liquids boiling above 1000° F. and contains unreacted coal and mineral matter, coal-derived residuum, and petroleum residuum. The addition of petroleum residuum to the coal liquefaction effluent should be controlled to maximize the amount of solids in the vacuum distillation bottoms fraction. The addition of petroleum residuum is preferably controlled to maximize the solids content of the bottoms fraction and so that the bottoms fraction is just pumpable. This is generally about 50% solids, which is also believed to be the maximum amount of solids which a vacuum distillation column can tolerate in the bottoms.

The vacuum distillation column bottoms comprising unreacted coal and mineral matter, coal-derived residuum and petroleum residuum are susceptible to many possible uses. For a high-severity liquefaction process, hydrogen consumption will be high and partial oxidation of the non-distillables produced from the coal would not meet the demand. In such a case, a low quality residuum could be added and the combined coal residuum-petroleum residuum-unreacted coal stream could be partially oxidized or gasified to provide all or part of the hydrogen requirement. The bottoms fraction could also be deasphalted or coked, used as fuel or for some other purpose.

Although the present invention has been described with reference to specific embodiments, it should be understood that these embodiments are described for illustrative purposes only and that numerous alterations and modifications can be practiced by those skilled in the art without departing from the scope of the invention. Accordingly, it is the intent that the present invention not be limited by the above, but be limited only as defined in the appended claims.

What is claimed is:

1. A process for liquefying coal comprising:

(a) heating a slurry comprising a petroleum or petroleum-derived solvent and particulate coal in a dissolution zone to substantially dissolve the coal to produce a first effluent containing undissolved solids;

(b) adding petroleum residuum from an external source to at least a portion of the first effluent to produce a second effluent containing said solids; and (c) distilling the second effluent under reduced pressure to produce an overhead fraction and a bottoms fraction containing said solids.

2. The process of claim 1, wherein the residuum has a solids content less than about 1%.

3. The process of claim 1, further comprising recycling at least a portion of the overhead fraction to the dissolution zone.

4. The process of claim 1, wherein conditions in the dissolution zone include a temperature of from about 400° C. to 480° C., a pressure of from about 70 to 700 atmospheres, a hydrogen gas rate of from about 170 to 3500 cubic meters per cubic meter of slurry, and a residence time of from about 0.1 to 3 hours.

5. The process of claim 1, wherein the dissolution zone contains a dispersed dissolution catalyst.

6. The process of claim 1, wherein the addition of petroleum residuum in step (b) is controlled so that the bottoms fraction of step (c) contains about 50% solids.

7. The process of claim 1, wherein the weight ratio of solvent to coal is from about 1:2 to 5:1.

8. A process for liquefying coal comprising:

(a) heating a slurry comprising a petroleum or petroleum-derived solvent and particulate coal in a dissolution zone to substantially dissolve the coal to produce a first effluent containing undissolved solids;

(b) contacting at least a portion of the first effluent with hydrogen in a reaction zone under hydrogenation conditions in the presence of an externally-supplied hydrogenation catalyst to produce a second effluent containing undissolved solids;

(c) adding petroleum residuum from an external source to at least a portion of the second effluent to produce a third effluent containing said solids; and (d) distilling the third effluent under reduced pressure to produce an overhead fraction and a bottoms fraction containing said solids.

9. The process of claim 8, wherein the residuum has a solids content of less than about 1%.

10. The process of claim 8, wherein hydrogenation conditions include a temperature of below 425° C., a pressure of from about 70 to 700 atmospheres, a hydrogen rate of from about 350 to 3500 cubic meters per cubic meter of slurry, and a slurry hourly space velocity of from about 0.1 to 2 hours$^{-1}$.

11. The process of claim 8, further comprising recycling at least a portion of the overhead fraction to the dissolution zone.

12. The process of claim 8, wherein conditions in the dissolution zone include a temperature of from about 400° C. to 480° C., a pressure of from about 70 to 700 atmospheres, a hydrogen gas rate of from about 170 to 3500 cubic meters per cubic meter of slurry, and a residence time of from about 0.1 to 3 hours.

13. The process of claim 8, wherein the dissolution zone contains a dispersed dissolution catalyst.

14. The process of claim 8, wherein the addition of petroleum residuum in step (c) is controlled so that the bottoms fraction of step (d) contains about 50% solids.

15. The process of claim 8, wherein the weight ratio of solvent to coal is from about 1:2 to 5:1.

* * * * *